US006681408B2

(12) United States Patent
Ku

(10) Patent No.: US 6,681,408 B2
(45) Date of Patent: Jan. 27, 2004

(54) IMPACT RESISTANT STRUCTURE OF SAFETY HELMET

(76) Inventor: Tun-Jen Ku, 16, Kuo Chung 2nd Rd., Da-Li City Taichung (TW)

( * ) Notice: Subject to any disclaimer, the term of this patent is extended or adjusted under 35 U.S.C. 154(b) by 0 days.

(21) Appl. No.: 10/058,161

(22) Filed: Jan. 25, 2002

(65) Prior Publication Data

US 2003/0140401 A1 Jul. 31, 2003

(51) Int. Cl.[7] ..... A42B 3/00
(52) U.S. Cl. ..... 2/413; 2/411; 2/DIG. 3
(58) Field of Search ..... 2/411, 412, 413, 2/414, 425, DIG. 3, 417, 418, 419

(56) References Cited

U.S. PATENT DOCUMENTS 3,248,738 A * 5/1966 Morgan ..... 2/414
3,713,640 A * 1/1973 Margan ..... 2/413
3,949,801 A * 4/1976 Sasaki ..... 16/75
4,023,213 A * 5/1977 Rovani ..... 2/413
4,038,700 A * 8/1977 Gyory ..... 2/413
4,287,613 A * 9/1981 Schulz ..... 2/413
4,566,137 A * 1/1986 Gooding ..... 2/413
4,991,230 A * 2/1991 Vacanti ..... 2/DIG. 3
5,259,071 A * 11/1993 Scott et al. ..... 2/413
5,263,203 A * 11/1993 Kraemer et al. ..... 2/413
5,402,535 A * 4/1995 Green ..... 2/413
5,846,063 A * 12/1998 Lakic ..... 2/413
5,890,232 A * 4/1999 Park ..... 2/413
6,226,801 B1 * 5/2001 Alexander et al. ..... 2/413

* cited by examiner

*Primary Examiner*—Rodney M. Lindsey
(74) *Attorney, Agent, or Firm*—W. Wayne Liauh

(57) ABSTRACT

A safety helmet comprises an impact-resistant structure which is fastened to the inner surface of a shell of the safety helmet and is formed of an impermeable fabric, a plurality of foam bodies enclosed by the impermeable fabric, and an air valve fastened to the impermeable fabric such that the air valve is in communication with the foam bodies via a plurality of air ducts.

2 Claims, 6 Drawing Sheets

IMPACT RESISTANT STRUCTURE OF SAFETY HELMET

FIELD OF THE INVENTION

The present invention relates generally to a safety helmet, and more particularly to an impact-resistant structure of the safety helmet.

BACKGROUND OF THE INVENTION

The conventional safety helmet is generally provided with an impact-resistant layer for protecting the head of a wearer of the safety helmet. The impact-resistant layer is made of an expanded polystyrene material which is relatively rigid and poor at absorbing the shock. As a result, the conventional safety helmet can not provide effectively its wearer the protection against the shock. In light of the rigidity of the expanded polystyrene material of the impact-resistant layer, the conventional safety helmet is not comfortable to wear.

As shown in FIG. 1, a prior art safety helmet has a shell 1 and an inner body 2 which is made of the expanded polystyrene and is fixed with the shell 1. The inner body 2 is provided with a hollow air sac 3 of a plastic material to give it an added comfort to the head wearing the safety helmet. The prior art safety helmet is relatively large in volume and therefore takes up a relatively large storage space. In addition, the prior art safety helmet is not cost-effective. Furthermore, the inner body 2 is not effective in absorbing shock. The air sac 3 is susceptible to a permanent deformation, which causes discomfort to a wearer of the safety helmet. In addition, the permanent deformation of the air sac 3 is a culprit for shortening the service life span of the safety helmet.

SUMMARY OF THE INVENTION

The primary objective of the present invention is to provide a safety helmet with a protective structure which is free of the deficiencies of the prior art safety helmets described above.

In keeping with the principle of the present invention, the foregoing objective of the present invention is attained by the safety helmet comprising a shell and an impact-resistant structure which is attached to the inner surface of the shell. The impact-resistant structure is formed of a plurality of breathable foam bodies, an impermeable fabric enclosing the breathable foam bodies, and an air valve attached to the impermeable fabric for inflating or deflating the breathable foam bodies via air ducts. The foam bodies are capable of absorbing shock effectively and are not susceptible to permanent deformation. The foam bodies can be adjusted in air density by the air valve.

The features and the advantages of the present invention will be more readily understood upon a thoughtful deliberation of the following detailed description of the present invention with reference to the accompanying drawings.

DETAILED DESCRIPTION OF THE INVENTION

Figure 1:
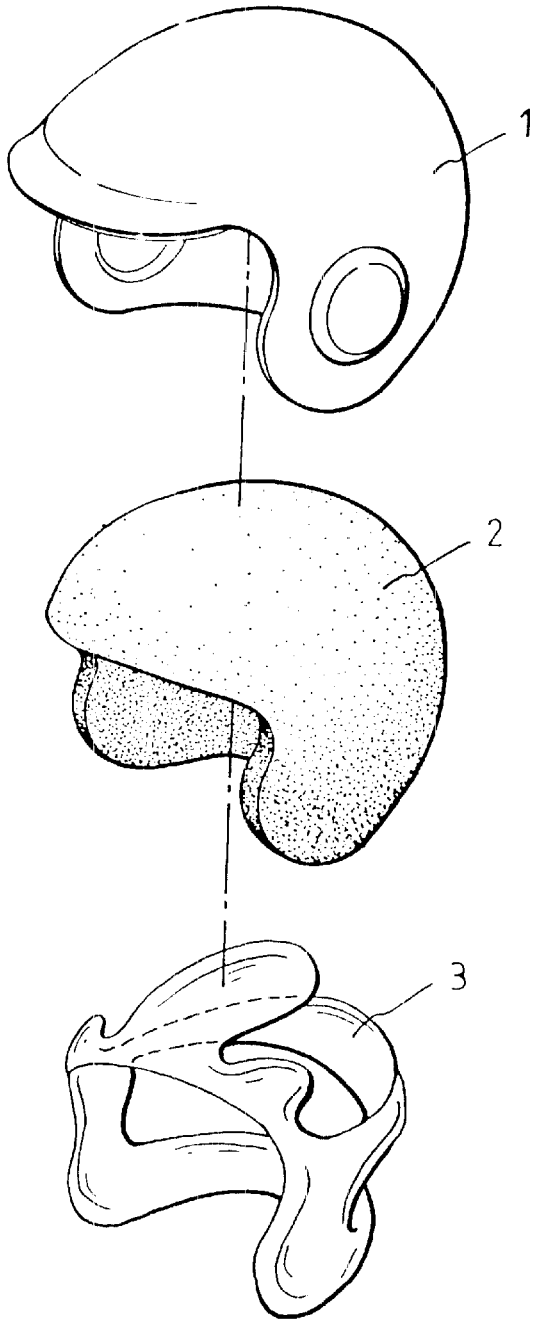
F I G . 1 PRIOR ART
FIG. 1 shows an exploded view of a safety helmet of the prior art.
Figure 2:
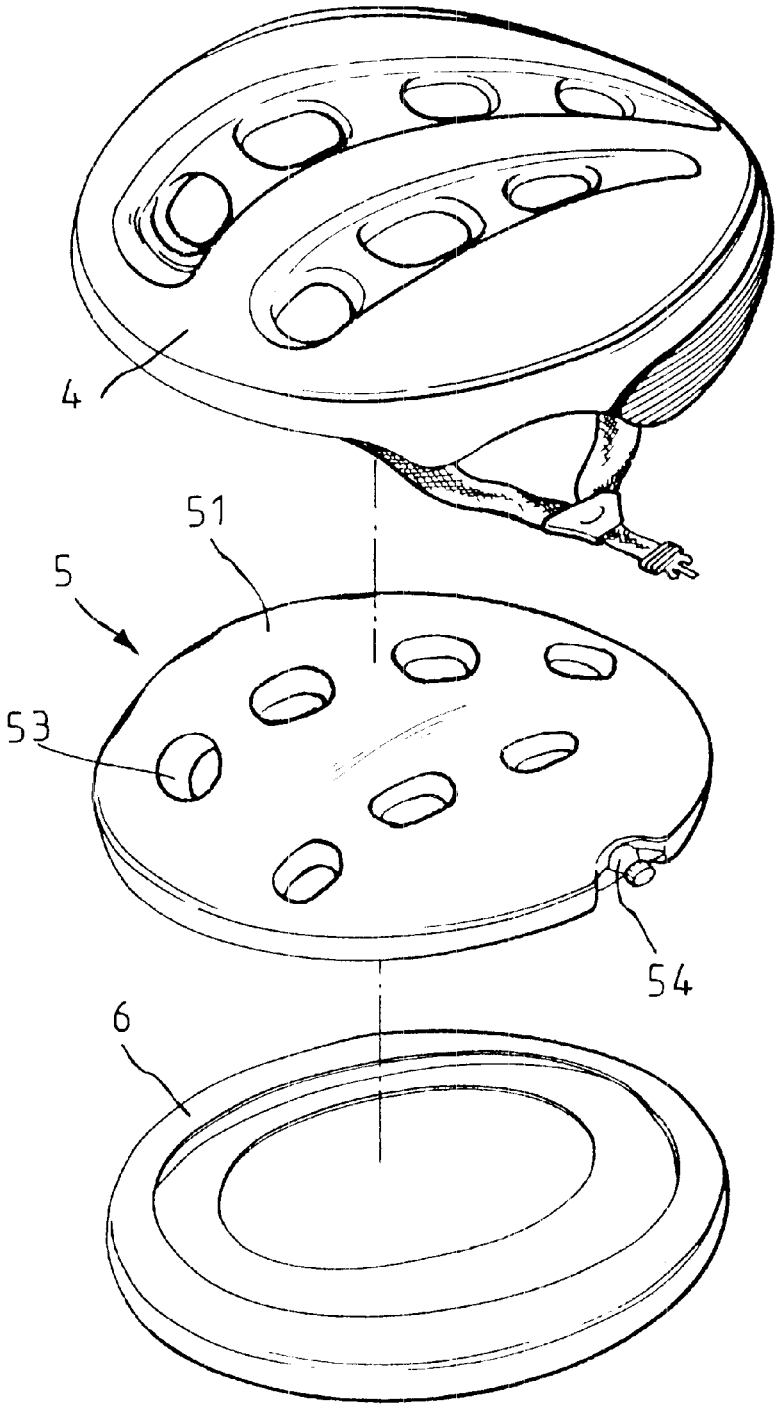
FIG. 2 shows an exploded view of a safety helmet of the present invention.
Figure 3:
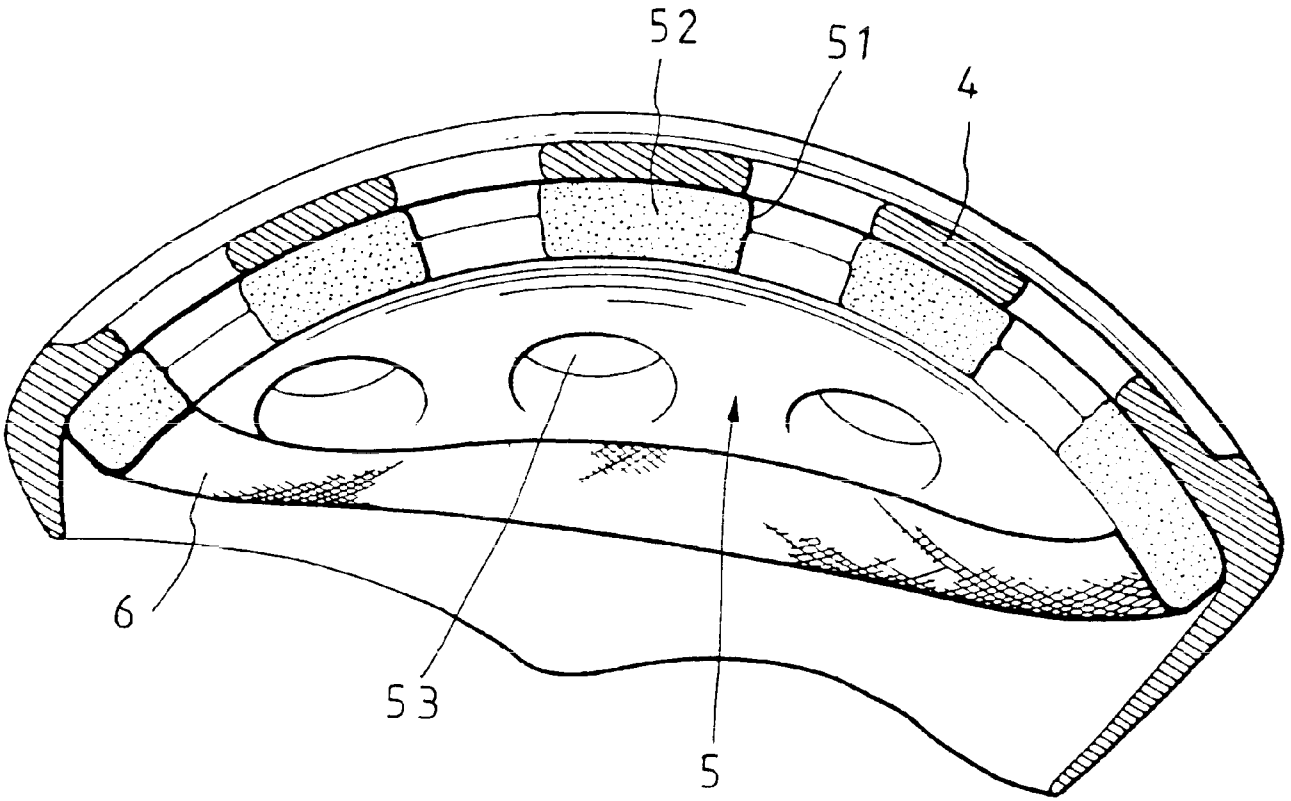
FIG. 3 shows a sectional view of the safety helmet of the present invention in combination.
Figure 4:
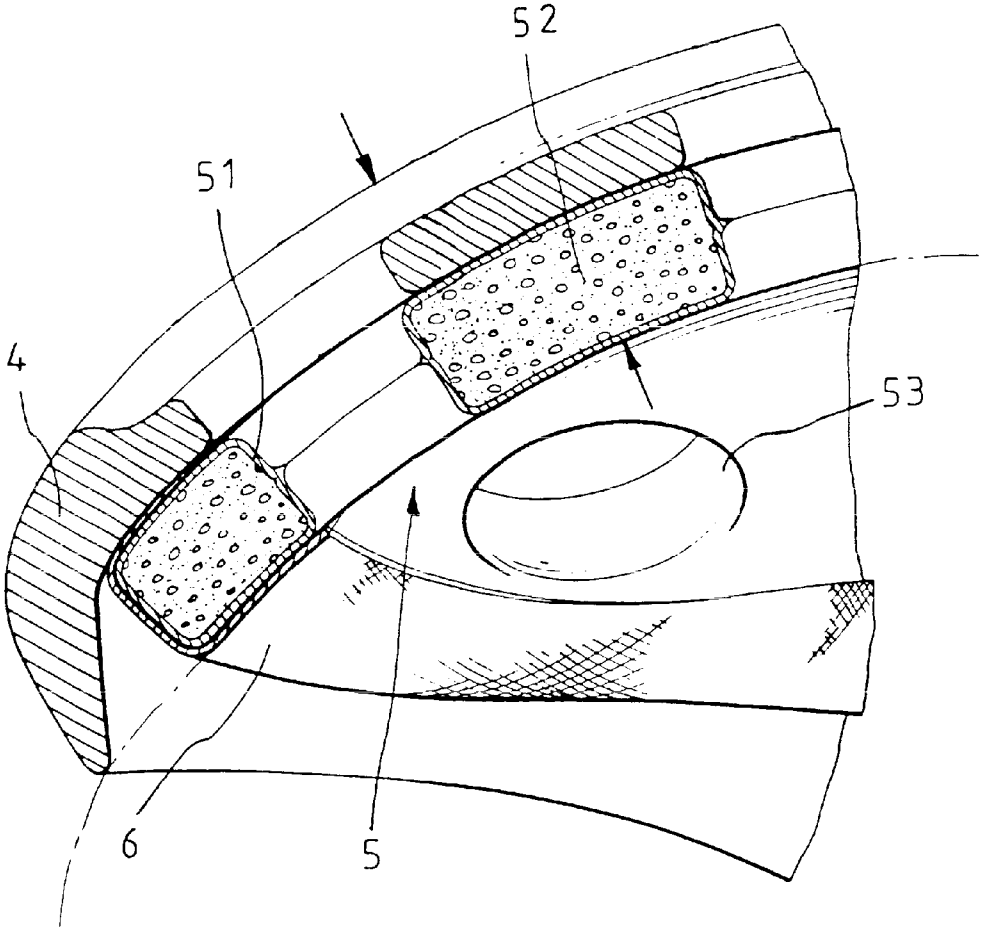
FIG. 4 shows a partial sectional view of the safety helmet of the present invention at work.
Figure 5:
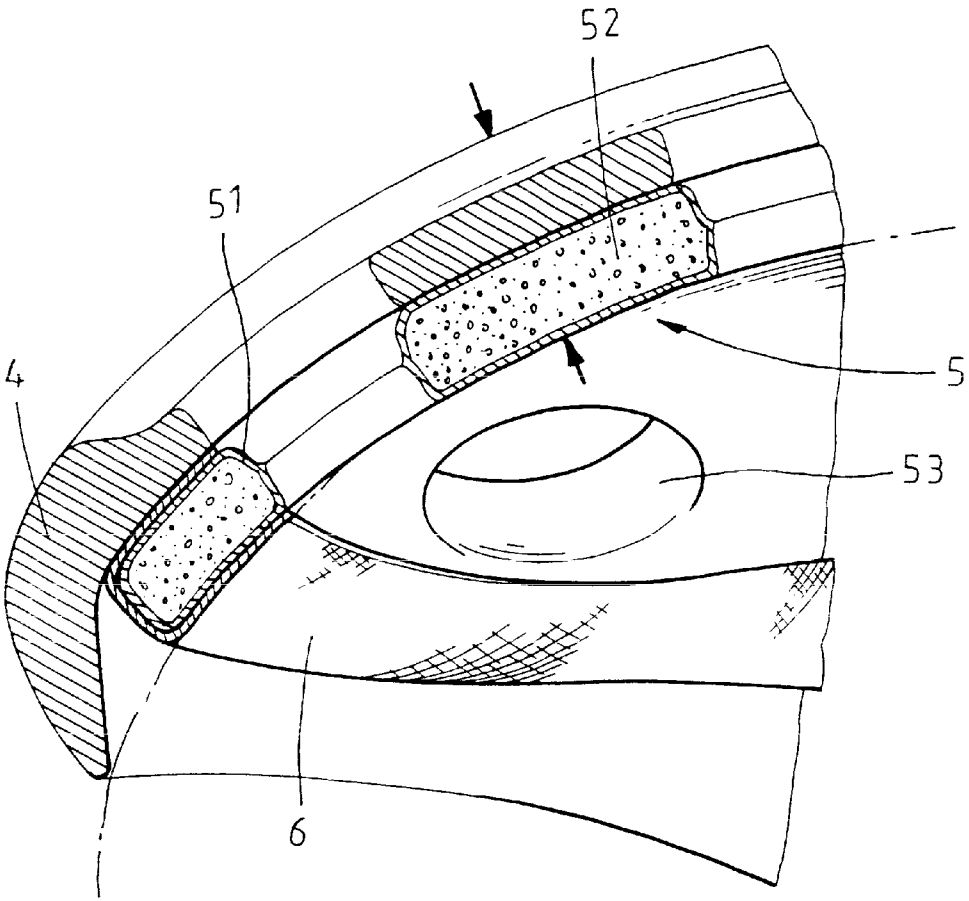
FIG. 5 shows another partial sectional view of the safety helmet of the present invention at work.

As shown in FIGS. 2–5, a safety helmet embodied in the present invention comprises a shell 4, an impact-resistant structure 5, and a lining 6.

The shell 4 is made of a rigid material. The impact-resistant structure 5 is attached to the inner surface of the shell 4 by an adhesive or Velcro device which is also known as a magic tape. The impact-resistant structure 5 is formed of an impermeable fabric 51, a plurality of breathable foam bodies 52 enclosed by the impermeable fabric 51, and an air valve 54 attached to the impermeable fabric 51 for inflating or deflating the breathable foam bodies 52. The lining 6 is made of a fabric or artificial sponge and is fastened to the impact-resistant structure 5.

The breathable foam bodies 52 are arranged at intervals and are independent of one another. The breathable foam bodies 52 serve to provide the safety helmet of the present invention with a shock-absorbing effect as well as a wearing comfort. The breathable foam bodies 52 can be inflated or deflated by the air valve 54 for adjusting the air density of the breathable foam bodies 52. In addition, the breathable foam bodies 52 are capable of self-adjustment of shape by virtue of the physical property thereof, so as to accommodate the head of a wearer of the safety helmet of the present invention.

Figure 6:
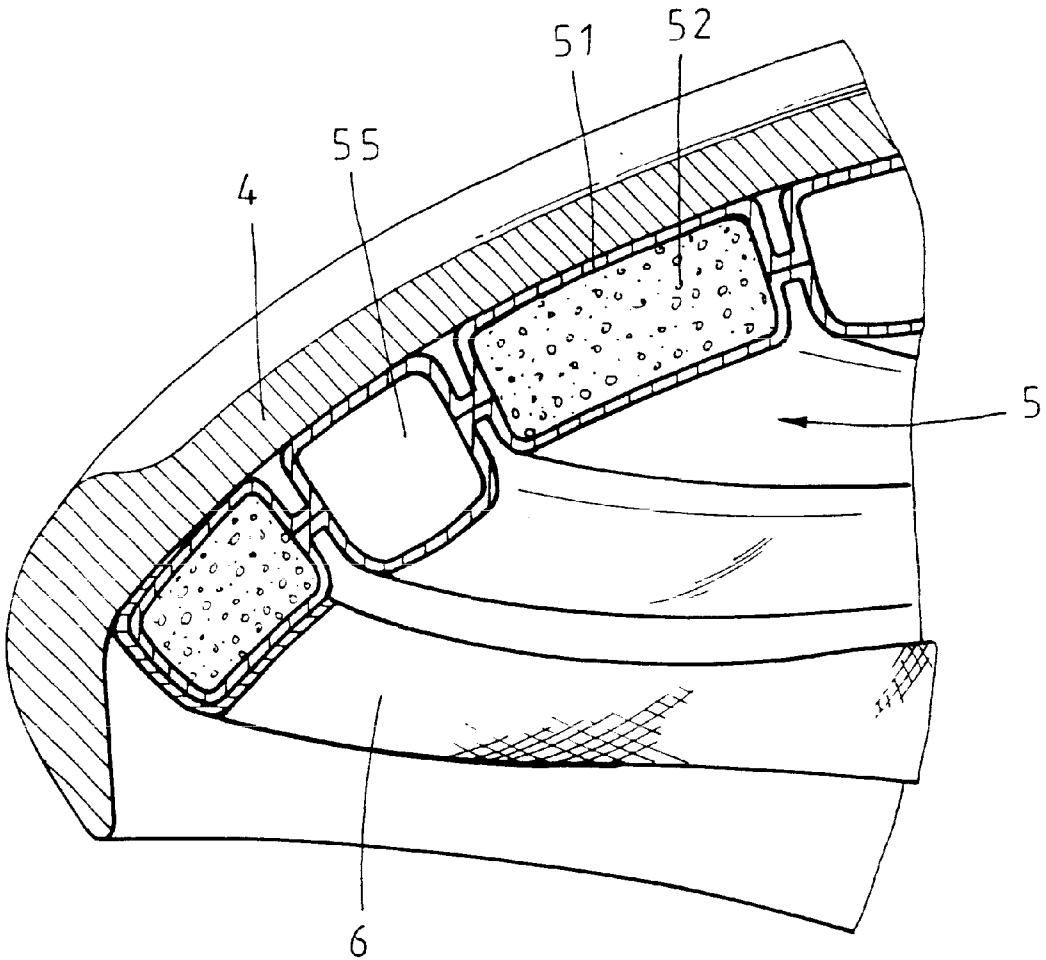
FIG. 6 shows a sectional schematic view of another embodiment of the present invention.

As shown in FIG. 6, the impact-resistant structure 5 of the present invention is further formed of a plurality of air cells 55, which are located between two breathable foam bodies 52 and can be inflated or deflated along with the breathable foam bodies 52 by the air valve 54. In other words, the breathable foam bodies 52 are reinforced by the air cells 55 in such a manner that the air cells 55 are so protruded as to form leading edged of the impact-resistant structure 5, thereby resulting in a reduction in the magnitude of impact force exerting on the breathable foam bodies 52.

The present invention described above is to be regarded in all respects as being merely illustrative and nonrestrictive. The present invention may be therefore embodied in other specific forms without deviating from the spirit thereof. The present invention is to be limited only by the scopes of the following claims.

What is claimed is:

1. A safety helmet comprising:

a shell made of a material having a rigidity;

an impact-resistant structure attached to an inner surface of said shell; and a lining fastened to said impact-resistant structure;

wherein said impact-resistant structure comprises:

an impermeable fabric;

a plurality of inflatable and deflatable foam bodies, said foam bodies are capable of effectively absorbing shock and are enclosed by said impermeable fabric and said foam bodies are arranged at intervals; and an air valve fastened with said impermeable fabric such that said air valve is in communication with said foam bodies to enable said foam bodies to be inflated or deflated by said air valve.

2. The safety helmet as defined in claim 1, wherein said impact-resistant structure further comprised a plurality of air cells, each being arranged between two of said foam bodies such that said air cell is inflated or deflated along with said foam bodies by said air valve.

* * * * *